US007651456B2

(12) United States Patent
Shimizu et al.

(10) Patent No.: US 7,651,456 B2
(45) Date of Patent: Jan. 26, 2010

(54) CENTRIFUGE HAVING A ROTOR TO SUPPRESS THE GENERATION OF SONORANTS

(75) Inventors: Yuki Shimizu, Ibaraki (JP); Shoji Kusumoto, Ibaraki (JP); Kenichi Nemoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 12/040,124

(22) Filed: Feb. 29, 2008

(65) Prior Publication Data

US 2008/0248939 A1 Oct. 9, 2008

(30) Foreign Application Priority Data

Mar. 20, 2007 (JP) ..... P2007-072972

(51) Int. Cl.
*B04B 5/02* (2006.01)

(52) U.S. Cl. ..... 494/16

(58) Field of Classification Search ..... 494/16, 494/20, 21, 31, 33, 85; 422/72
See application file for complete search history.

(56) References Cited

U.S. PATENT DOCUMENTS 3,970,245 A * 7/1976 Aeschlimann ..... 494/9
5,071,402 A * 12/1991 Weyant, Jr. ..... 494/16
2008/0248939 A1 * 10/2008 Shimizu et al. ..... 494/20

FOREIGN PATENT DOCUMENTS

| | | | |
|---|---|---|---|
| JP | 58-6257 | * | 1/1983 |
| JP | 60128747 | | 8/1985 |
| JP | U-04-53463 | | 5/1992 |
| JP | 8-103689 | | 4/1996 |
| JP | 08309232 A | * | 11/1996 |
| JP | 10-034019 | | 2/1998 |
| JP | 2001300350 | | 10/2001 |

OTHER PUBLICATIONS

Machine Translation of Japan 8-309232 published Nov. 26, 1996.*
English Translation of Japanese Patent Office Notice for Submission of Opinion, pp. 1-6, dated Feb. 2009.

* cited by examiner

*Primary Examiner*—Charles E Cooley
(74) *Attorney, Agent, or Firm*—Brundidge & Stanger, P.C.

(57) ABSTRACT

According to an aspect of the invention, there is provided a rotor for a centrifuge which includes an annular portion having a plurality of storing portions each holding a sample vessel that contains a sample to be separated, the annular portion being provided with an end face portion at which holes of the storing portions are opened so as to be aligned in a circumferential direction thereof. Concave portions are disposed each between a corresponding pair of the adjacent holes on the end face portion.

4 Claims, 5 Drawing Sheets

CENTRIFUGE HAVING A ROTOR TO SUPPRESS THE GENERATION OF SONORANTS

CROSS-REFERENCE TO RELATED APPLICATIONS

This application is based on and claims the benefit of priority from the prior Japanese Patent Application No. 2007-072972, filed on Mar. 20, 2007; the entire contents of which are incorporated herein by reference.

TECHNICAL FIELD

The present invention relates to a centrifuge and a centrifuge rotor used in a centrifuge.

BACKGROUND

A centrifuge is configured in a manner that a sample to be separated is inserted into a rotor via a vessel such as a tube or a bottle and then the rotor is rotated at a high speed thereby to separate and refine the sample. The rotors differ in the usage thereof depending on the rotation speed and include various types of rotors such as an angle rotor in which a tube hole is fixed and a swing rotor in which a bucket loaded with a tube swings from a vertical state to a horizontal state in accordance with the rotation of the rotor.

In high-speed small-amount centrifuges for separating a small amount of sample quickly, mainly the angle rotors are often employed. It is disclosed by, for example, JP-A-8-103689 that a conventional angle rotor for a centrifuge is mainly formed by cutting an aluminum block or molding plastics and is configured in a manner that a plurality of tube holes for holding the tube are disposed with the interval of a constant angle with respect to a rotation shaft. The opening end face of the tube hole is formed concentrically with the rotation shaft at its conical surface.

Some of the angle rotors are each provided with a rotor cover so as not to expose rough surfaces formed when inserting the tube into the rotor to the atmosphere in order to suppress the rotation loss due to wind to the minimum. Some kinds of rotors fabricated in recent years are arranged to allow use in a state of being attached with the rotor cover or in a state of not being attached with the rotor cover. In such a rotor, when the number of tubes containing a sample are large, the rotor cover is required to be removed and attached each time the tube having been separated is replaced by the tube before the separation. Thus, actually, an operator often uses the rotor without attaching the rotor cover.

In the case of the angle rotor disclosed in JP-A-8-103689, a resonant sound or sonorant, a so-called whistling, sound may be generated at the tube hole in which the tube is not inserted. It is disclosed by, for example, JP-A-10-34019 that a through hole communicates the space within the tube hole with the outside of the rotor is provided in order to avoid such a phenomenon.

SUMMARY

However, when the through hole communicating with the outside of the rotor is formed at the tube hole, there arises a fear that the loss of the rotor due to the wind becomes large, which results in the increase of energy relating to the rotation of the rotor. Further, in recent years there arises a problem of biosafety. That is, in the case where the rotor is provided with the through hole communicating with the outside of the rotor, if the tube is broken, sample may be discharged and scattered outside of the rotor through the through hole, which is against the biosafety.

Accordingly, an object of the invention is to provide a centrifuge rotor and a centrifuge which can realize the biosafety while suppressing sonorants.

In order to solve the aforesaid problems, the invention provides a rotor for a centrifuge which includes an annular portion having a plurality of storing portions each holding a sample vessel that contains a sample to be separated, the annular portion being provided with an end face portion at which holes of the storing portions are opened so as to be aligned in a circumferential direction thereof, wherein convex portions or concave portions are disposed each between a corresponding pair of the adjacent holes on the end face portion.

According to this configuration, the degree of the friction between the end face portion and the air can be increased. Thus, the flow rate of the relative flow of the air generated at the end face portion when the rotor is rotated can be reduced. Since the flow rate is reduced, the generation of sonorants can be suppressed. Further, since there is not provided in the rotor a hole for communicating the storing portion and the outer peripheral portion, a sample can be prevented from being leaked outside from the storing portion during the centrifuging operation.

In the centrifuge rotor thus configured, the concave portion may be configured by a groove portion for communicating the adjacent holes.

According to this configuration, the depth of the storing portion relation to the generation of sonorants can be made small. When that depth is made small, since the frequency relation to the resonance can be made high, the generation of sonorants can be suppressed.

Alternatively, in order to solve the aforesaid problems, the invention provides a rotor for a centrifuge which includes an annular portion having a plurality of storing portions each holding a sample vessel that contains a sample to be separated, the annular portion being provided with an end face portion at which holes of the storing portions are opened so as to be aligned in a circumferential direction thereof, wherein the annular portion is formed in a conical shape and provided with a recess portion which side wall is formed by the annular portion, and the annular portion is further provided with a though hole which opens to an inner peripheral surface of the recess portion and communicates the recess portion and inner portions of the storing portions According to this configuration, also, the depth of the storing portion relating to the generation of sonorants can be made small. When the depth is made small, since the frequency relating to the resonance can be made high, the generation of sonorants can be suppressed. Further, since there is not provided in the rotor a hole for communicating the storing portion and the outer peripheral portion, a sample can be prevented from being leaked outside from the storing portion during the centrifuging operation.

Alternatively, in order to solve the aforesaid problems, the invention provides a centrifuge including the centrifuge rotor configured in the aforesaid manner.

According to the centrifuge rotor and the centrifuge of the invention, the biosafety can be realized while suppressing the generation of sonorants.

DESCRIPTION OF THE EMBODIMENTS

Figure 1:
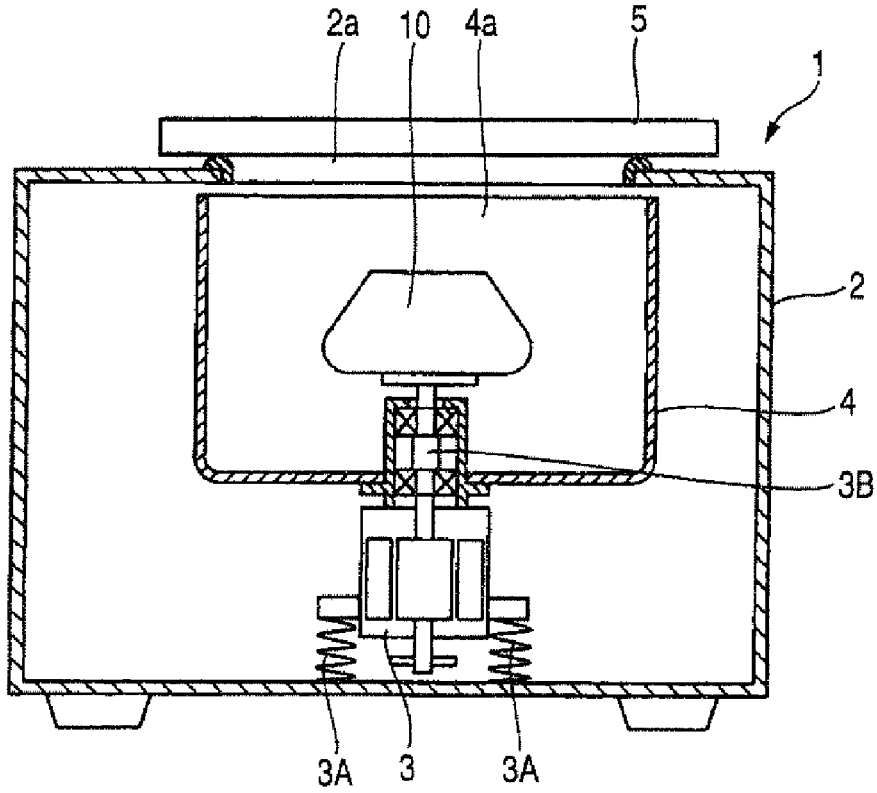
FIG. 1 is a sectional diagram of the centrifuge according to the first embodiment of the invention.
Figure 2:
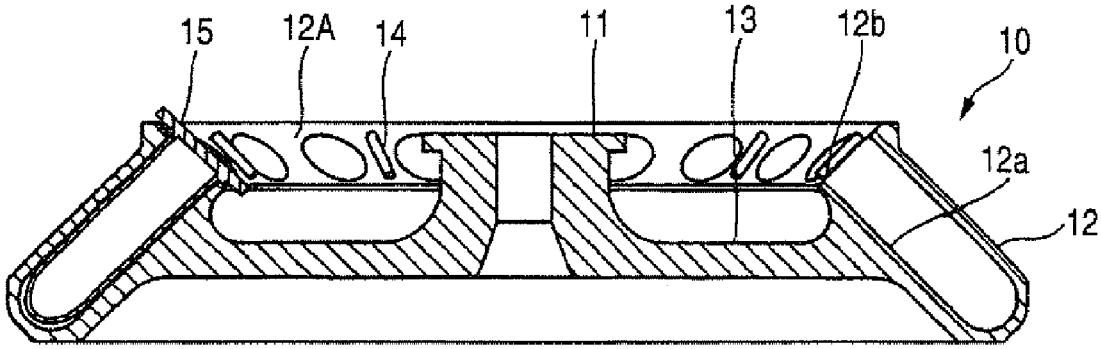
FIG. 2 is a sectional diagram of the centrifuge rotor according to the first embodiment of the invention.

Hereinafter, the centrifuge rotor and the centrifuge according to the first embodiment of the invention will be explained with reference to FIGS. 1 to 4. The centrifuge 1 shown in FIG. 1 is mainly configured by a housing 2, a motor 3, a rotation room chamber 4, a lid 5 and a rotor 10.

The housing 2 serves as the outer shell of the centrifuge and contains therein a motor 3, the rotation room chamber 4, the rotor 10 and a not-shown control device etc. An opening portion 2*a* serving as the opening of a rotation room 4*a* described later is formed at the upper portion of the housing 2.

The motor 3 includes a rotation shaft portion 3B serving as an output shaft and is provided in a manner that the motor 3 is directed upward within the housing 2 via dampers 3A, 3A. The motor 3 can rotate the rotor 10 at about 15,000 rpm at the maximum.

The rotation room chamber 4 is provided at the upper portion of the motor 3 beneath the opening portion 2*a* and defines the rotation room 4*a* therein. The end portion of the rotational axis portion 3B penetrates the rotation room chamber 4 and protrudes within the rotation room 4*a*. The lid 5 is disposed at the upper portion of the housing 2 so as to be able to open and close the opening portion 2*a* of the rotation room 4*a*.

The rotor 10 is mainly configured by a shaft portion 11, an annular portion 12 and a recess portion 13 for coupling the shaft portion 11 and the annular portion 12. The rotor is housed within the rotation room 4*a* and fixed at the shaft portion 11 to the rotation shaft portion 3B so as to be rotatable coaxially. The annular portion 12 is configured in a conical shape having a head portion and includes storing portions 12*a* which are aligned in the circumferential direction thereof and each of which is disposed from the apex side of the conical shape toward the foot side thereof. A sample vessel 15 containing a sample to be centrifuged therein can be inserted into each of the storing portions 12*a*.

The annular portion 12 is provided with an end face portion 12A at which holes 12*b* respectively corresponding to the opining portions of the storing portions 12*a* are opened. The end face portion 12A is configured so as to cross with the direction toward the foot side from the apex side of the conical shape and to continue in the rotation direction of the rotor 10. In the end face portion 12A, a convex portion 14 protruding from the end face portion 12A is provided between each pair of the adjacent holes 12*b*. The convex portion 14 is disposed in a manner that its longitudinal direction is almost orthogonal to rotation direction.

Figure 3:
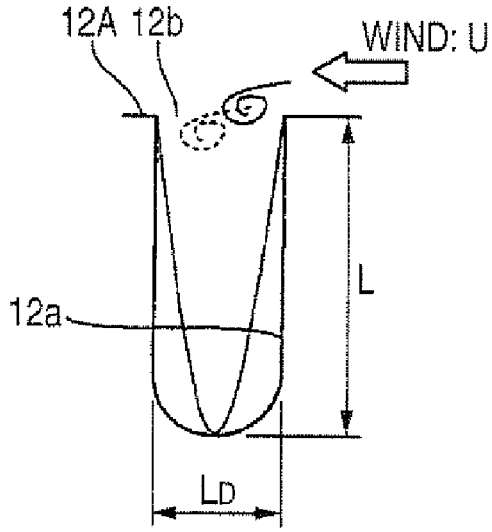
FIG. 3 is a schematic diagram showing the relation between an eddy and the tube length in the storing portion of the centrifuge rotor according to the first embodiment of the invention.

In the centrifuge 1 configured in this manner, the explanation will be made as to a case where the rotor 10 is rotated in a state that the sample vessel 15 is not inserted into any of the storing portions 12*a*. When the rotor 10 rotates, wind is generated relatively on the end face portion 12A. In this case, as shown in FIG. 3, a periodical eddy is generated near the hole 12*b*. An eddy radiation frequency fc representing the frequency with which such the periodical eddy is radiated is given by the following expression.

$$fc=(n-0.25)/(M+1.75)\cdot U/LD \qquad \text{expression 1}$$

where M depicts the Mach number, U depicts a representative flow rate, LD depicts the length of the opening portion and n depicts the mode (1, 2, 3, - - - ).

Figure 4:
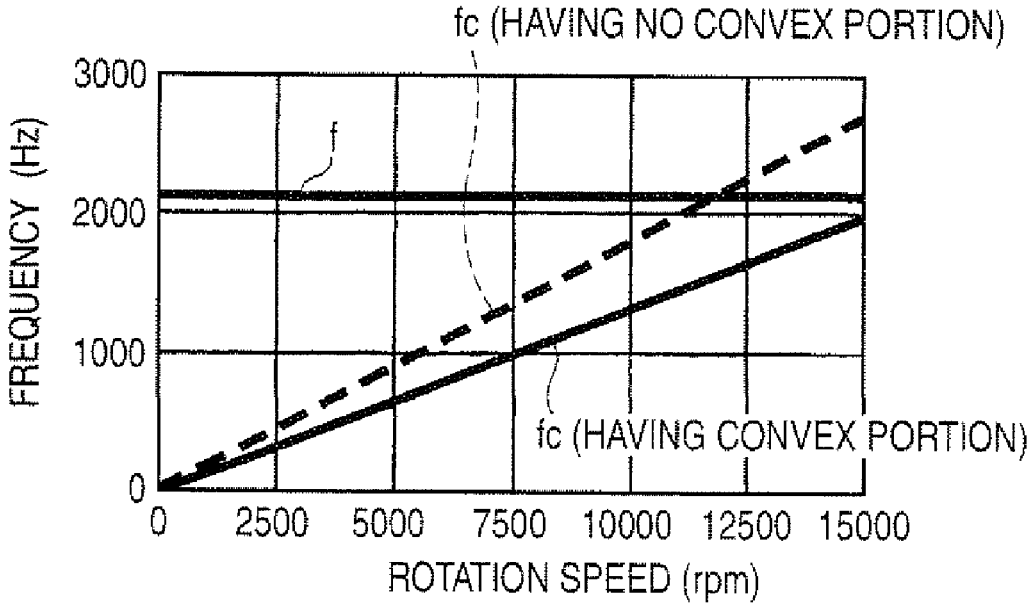
FIG. 4 is a graph showing the relation between the eddy radiation frequency and the resonance frequency of the centrifuge rotor according to the first embodiment of the invention.

The length of the opening portion is constant. The representative flow rate increases and reduces in accordance with the rotation speed of the rotor 10. The Mach number depends on the representative flow rate and is equal to 0 or more but about 2 at the maximum. Thus, as shown in FIG. 4, the eddy radiation frequency increases in proportional to the rotation speed of the rotor 10.

Further, since the storing portion 12*a* having the opened hole 12*b* is a closed tube, the storing portion resonates and the resonance frequency f thereof is given by the following expression.

$$f=(2n-1)/4\cdot c/L \qquad (2)$$

where C depicts the sound velocity, L depicts the length of the tube and n depicts the mode (1, 2, 3, - - - ).

Since each of the sound velocity and the length of the tube is a constant value, the resonance frequency becomes constant as shown in FIG. 4.

When the rotation speed of the rotor 10 is raised, the flow rate of the wind relatively generated near the hole 12*b* is increased and so the eddy radiation frequency increases. When the eddy radiation frequency reaches the resonance frequency, the resonance occurs and so the so-called whistling sound is generated. However, since the convex portion 14 is provided near the storing portion 12*a*, the degree of the friction between the end face portion 12A and the air becomes large. Thus, since the air near the end face portion 12A is excessively pulled, the flow rate of the wind relatively generated near the hole 12*b* reduces. In the state where the convex portions 14 are provided, the eddy radiation frequency is smaller as compared with the state where the convex portion 14 is not provided at all even if the rotation speed of the rotor 10 is the same. Thus, even if the motor 3 is rotated at the maximum speed (15,000 rpm), since the eddy radiation frequency does not reach the resonance frequency, the generation of the so-called whistling sound can be suppressed.

Further, in the first embodiment, the whistling sound is reduced without directly forming a hole etc. at the storing portion 12*a*. Thus, even in the case where the sample vessel 15 is broken within the storing portion 12*a*, sample can be prevented from being discharged from the storing portion 12*a*.

Figure 5:
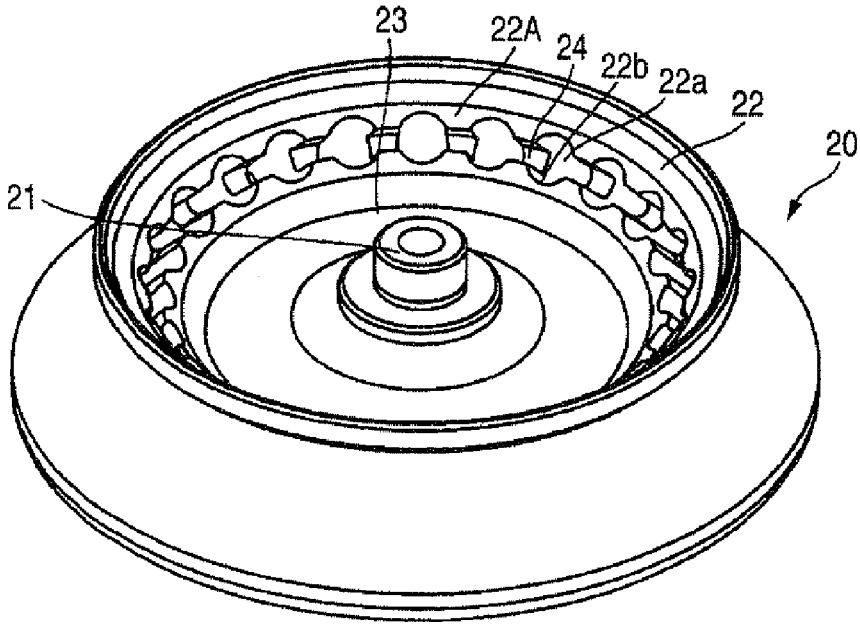
FIG. 5 is a perspective view of the centrifuge rotor according to the second embodiment of the invention.

Next the centrifuge and the centrifuge rotor according to the second embodiment of the invention will be explained with reference to FIGS. 5 to 7. Since the centrifuge according to the first embodiment except is the same as the centrifuge 1 according to the first embodiment except for the configuration of a rotor 20 shown in FIG.5, the explanation thereof will be omitted.

The rotor 20 is mainly configured by a shaft portion 21, an annular portion 22 and a recess portion 23 for coupling the shaft portion 21 and the annular portion 22. The rotor is housed within the rotation room 4*a* and fixed at the shaft portion 21 to the rotation shaft portion 3B (see FIG. 1) so as to be rotatable coaxially. The annular portion 22 is configured in a conical shape having a head portion and includes storing portions 22*a* which are aligned in the circumferential direction thereof and each of which is disposed from the apex side of the conical shape toward the foot side thereof. The sample vessel 15 (see FIG. 2) containing a sample to be centrifuged therein can be inserted into each of the storing portions 22*a*.

The annular portion 22 is provided with an end face portion 22A at which holes 22*b* respectively corresponding to the opening portions of the storing portions 22*a* are opened. The end face portion 22A is configured so as to cross with the direction toward the foot side from the apex side of the conical shape and to continue in the rotation direction of the rotor 20. In the end face portion 22A, groove portions 24 are formed so as to couple the corresponding pair of one hole 22*b* and another hole 22*b* disposed adjacently to each other.

Figure 6:
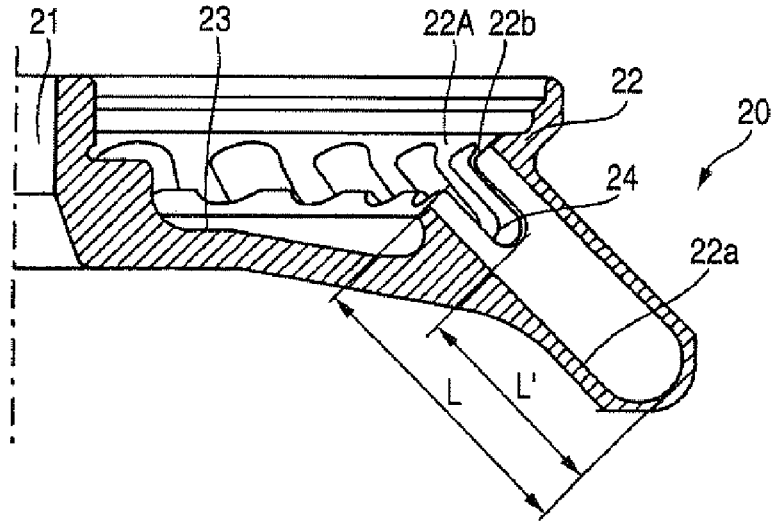
FIG. 6 is a partial sectional diagram showing the centrifuge rotor according to the second embodiment of the invention.
Figure 7:
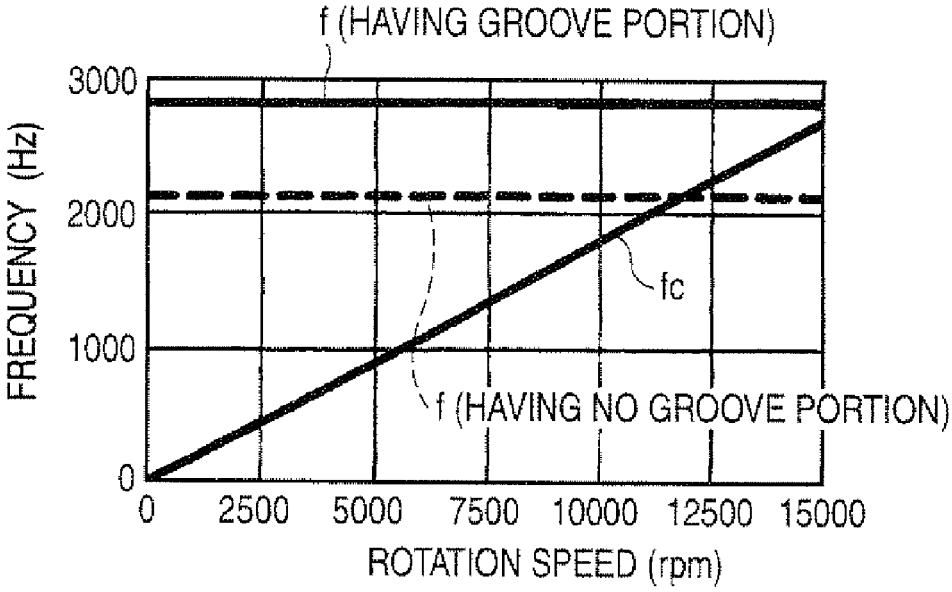
FIG. 7 is a graph showing the relation between the eddy radiation frequency and the resonance frequency of the centrifuge rotor according to the second embodiment of the invention.

Since the groove portions 24 are provided, as shown in FIG. 6, the length L of the tube relating to the resonance frequency can be shortened to L'. Thus, as clear from the expression (2), the resonance frequency relating to the storing portion 22*a* becomes high as compared with the case where the groove portion 24 is not provided, as shown in FIG. 7. Therefore, even if the motor 3 is rotated at the maximum speed (15,000 rpm), since the eddy radiation frequency does not reach the resonance frequency, the generation of the so-called whistling sound can be suppressed.

Figure 8:
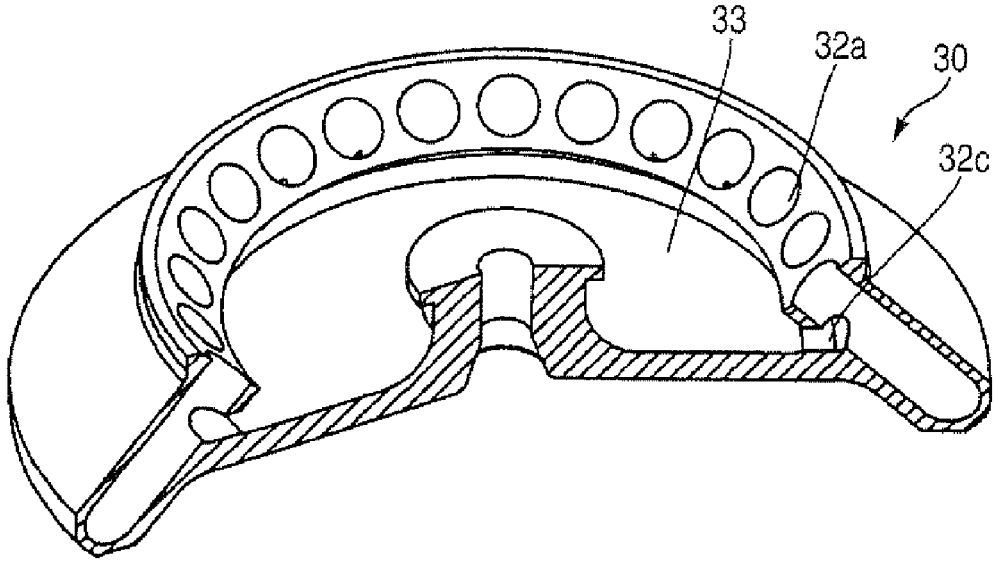
FIG. 8 is a perspective sectional view of the centrifuge rotor according to the modified example of the second embodiment of the invention.
Figure 9:
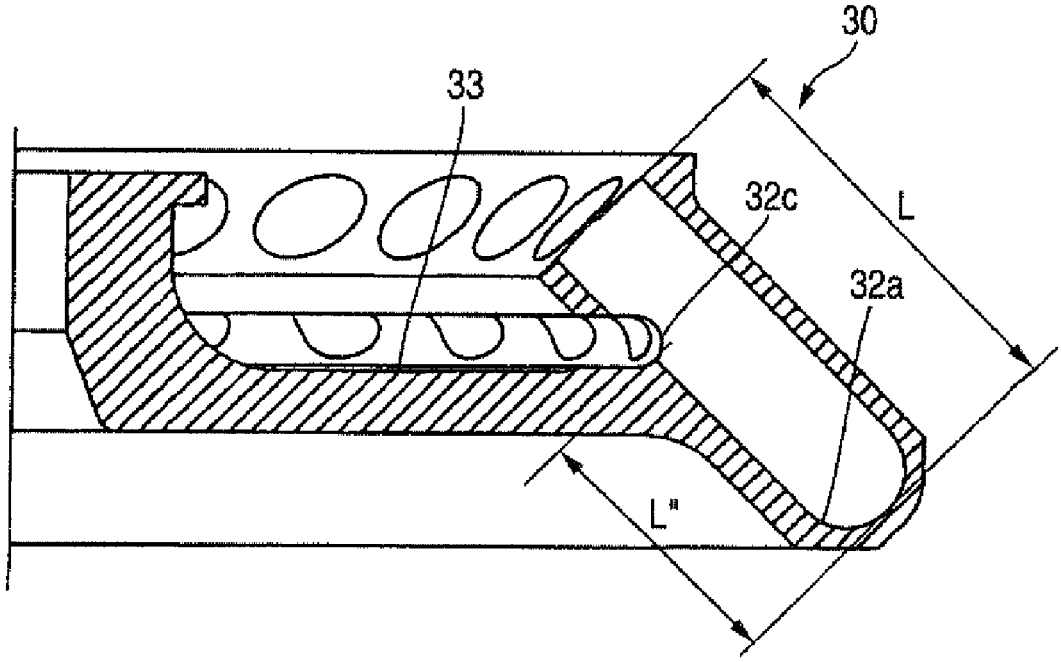
FIG. 9 is a partial sectional diagram showing the centrifuge rotor according to the modified example of the second embodiment of the invention.

As a modified example of the second embodiment, as shown in FIG. 8, a rotor 30 may be employed which is configured to have a through hole 32*c* that opens to the inner peripheral surface of a recess portion 33 and communicates the recess portion 33 and the inner portions of storing portions 22*a*. In such a configuration, also, the length L of the tube relating to the resonance frequency can be shortened to L" as shown in FIG. 9. Thus, like the second embodiment, in the rotor 30 according to the modified example, since the eddy radiation frequency does not reach the resonance frequency, the generation of the so-called whistling sound can be suppressed.

In the second embodiment and the modified example thereof, the groove or the through hole is formed at the storing portion. However, since a through hole etc. is not formed at the outer peripheral portion of the annular portion, even when the sample vessel 15 is broken during the centrifuging operation, a sample can be prevented from being discharged to the outside of the rotor.

The centrifuge and the centrifuge rotor according to the invention are not limited to the aforesaid embodiments and may be modified and improved in various manners within a range described in claims. For example, although, in the first embodiment, the convex portions are provided so as to increase the degree of the friction between the end face portion and the air thereby to reduce the relative speed, the degree of the friction between the end face portion and the air may be increased by providing a concave portion. The concave portion may be configured like the groove portion 24 shown in the second embodiment or merely may be through holes each of which is opened at the end face portion and formed between the one storing portion and another storing portion disposed adjacently to each other.

What is claimed is:

1. A rotor for a centrifuge which includes an annular portion having a plurality of storing portions each holding a sample vessel that contains a sample to be separated, the annular portion being provided with an end face portion at which holes of the storing portions are open, wherein a groove is formed between each pair of the adjacent storing portions and is disposed to extend in the rotation direction of the rotor to connect the adjacent storing portions.

2. A centrifuge including the centrifuge rotor according to claim 1.

3. A rotor for a centrifuge which includes an annular portion having a plurality of storing portions each holding a sample vessel that contains a sample to be separated, the annular portion being provided with an end face portion at which holes of the storing portions are opened so as to be aligned in a circumferential direction thereof, wherein the annular portion is formed in a conical shape and provided with a recess portion which side wall is formed by the annular portion, and the annular portion is provided with a through hole which opens to an inner peripheral surface of the recess portion and communicates the recess portion and inner portions of the storing portions.

4. A centrifuge including the centrifuge rotor according to claim 3.

* * * * *